United States Patent [19]

Mitchell et al.

[11] Patent Number: 4,572,145

[45] Date of Patent: Feb. 25, 1986

[54] MAGNETIC FUEL LINE DEVICE

[75] Inventors: John Mitchell, Palm Springs, Calif.; Charles E. Ament, Rye, N.Y.

[73] Assignee: Ament Enterprises, Inc., Rye, N.Y.

[21] Appl. No.: 680,585

[22] Filed: Dec. 11, 1984

Related U.S. Application Data

[63] Continuation of Ser. No. 638,527, Aug. 6, 1984, abandoned, which is a continuation of Ser. No. 471,999, Mar. 4, 1983, abandoned.

[51] Int. Cl.[4] ..... F02B 75/10

[52] U.S. Cl. ..... 123/538; 123/536; 210/222

[58] Field of Search ..... 123/537, 538, 536, 539; 210/222, 695

[56] References Cited

U.S. PATENT DOCUMENTS

| | | | |
|---|---|---|---|
| 3,116,726 | 1/1964 | Kwantz | 123/538 |
| 3,349,354 | 10/1967 | Miyata | 123/536 |
| 4,050,426 | 9/1977 | Sanderson | 123/538 |
| 4,381,754 | 5/1983 | Heckel | 123/538 |
| 4,414,951 | 11/1983 | Sanzto | 123/536 |

FOREIGN PATENT DOCUMENTS

| | | | |
|---|---|---|---|
| 1092917 | 1/1981 | Canada | 123/538 |
| 191448 | 11/1982 | Japan | 210/695 |

*Primary Examiner*—Ronald H. Lazarus

*Attorney, Agent, or Firm*—Stiefel, Gross, Kurland & Pavane

[57] ABSTRACT

The performance of an engine is improved by forming a magnetic field in a portion of a fuel line leading to the engine and causing fuel to be burned in the engine to traverse and interact with the magnetic field. The magnetic field is formed through use of a magnet which is oriented so that its South pole is adjacent the fuel line and its North pole is spaced apart from the fuel line. The magnet is embedded in a U-shaped body of non-magnetic material which is adopted to fit over the fuel line.

6 Claims, 2 Drawing Figures

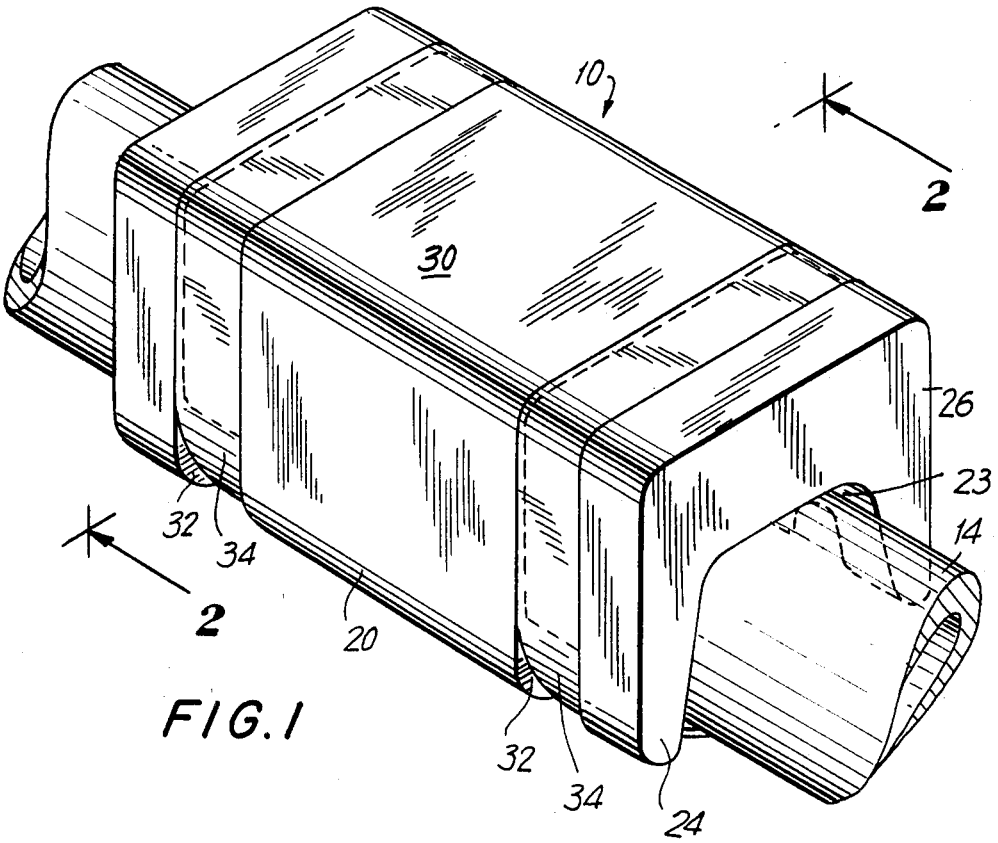
FIG. 1
FIG. 2
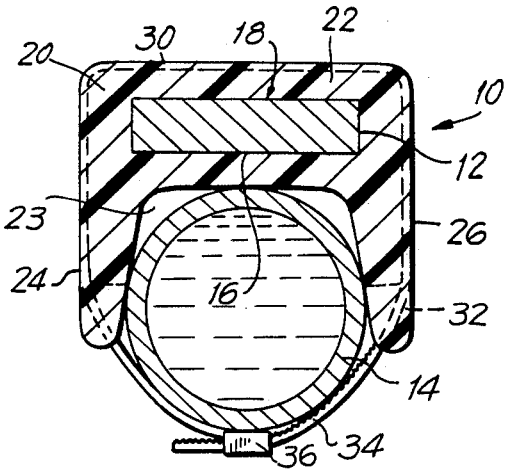

MAGNETIC FUEL LINE DEVICE

This is a continuation of application Ser. No. 06/638,527, filed 08/06/84 now abandoned, which is a continuation of application Ser. No. 471,999, filed Mar. 4, 1983, now abandoned.

TECHNICAL FIELD

This invention relates to a method and apparatus for improving the performance of an automobile or truck engine.

BACKGROUND ART

Two major problems which face our modern automobile based society are air pollution and energy economy. In order to increase fuel efficiency, automobiles and trucks have been designed to weigh less and to have aerodynamic shapes. In order to reduce pollutants, various types of pollution control equipment such as catalytic converters have been required in automobile and truck engines. However, such catalytic converters, while satisfactory under certain conditions for reducing pollutants are cumbersome, expensive, and detract from rather than enhance fuel economy.

Other efforts to improve the fuel efficiency of engines and to reduce polluting emissions have involved the processing of fuel in a fuel line leading to an engine by forming a magnetic field in a portion of the fuel line and causing the fuel to be processed to traverse and interact with the magnetic field. Such a unit is described in commonly owned copending U.S. patent application Ser. No. 352,535, filed Feb. 26, 1982 now abandoned, entitled Fuel Line Device For Improving The Efficiency Of An Engine, naming John Mitchell as inventor therefor. Units for performing such processing as described in the aforementioned application, generally comprise a tube which is inserted into the fuel line and a pair of magnets embedded in a non-magnetic material and mounted adjacent the tube for forming the magnetic field. In such fuel processing units, the magnets are oriented such that their North poles are proximate the tube and the South poles are spaced apart from the tube.

Such units although consituting an improvement over the prior art, still have two main shortcomings. First they do not use an optimum magnetic field configuration for achieving maximum fuel economy and second they are cumbersome to install as they involve the cutting of the fuel line and the insertion of a tube into the cut fuel line through the use of hoses and clamps.

Accordingly, the object of the present invention is a magnetic device for processing fuel in a fuel line leading to an engine which is easy to install and which uses a magnetic field configuration which maximizes fuel economy.

DISCLOSURE OF THE INVENTION

The present invention is an apparatus which, when used in a fuel line leading to the engine of an automobile or truck results in improved fuel efficiency and reduced amounts of polluting emissions.

Generally, the present invention involves processing fuel in a fuel line leading to an engine by forming a magnetic field in a portion of the fuel line and causing the fuel to be processed to traverse and interact with the magnetic field. The magnet for producing the magnetic field is oriented so that its South pole is located adjacent the fuel line and its North pole is located spaced apart from the fuel line. This configuration of magnetic field results in an actually measured improvement in fuel economy over and above that achieved with the unit described in the above-referred to patent application, the contents of which are specifically incorporated by reference herein in their entirety. The unit referred to in the above-referred to patent application comprises a pair of magnets, each of which has its North pole located adjacent a tube which is inserted into a cut fuel line.

In the fuel unit of the present invention, the magnet is embedded in a body of non-magnetic material, such as plastic. The body of non-magnetic material has a groove formed therein so that it can fit over the fuel line. Typically, the groove may be a V-shaped groove or a U-shaped groove. Straps may be used to secure the body of non-magnetic material to the fuel line. In the case of a gasoline engine, the fuel saving unit is installed on the fuel line between the fuel pump and the carburetor. In contrast with the above-mentioned fuel unit, no cutting of the fuel line and no hose and clamps are necessary to install the inventive fuel unit. In addition to achieving significant fuel economy, use of the inventive fuel unit result in a reduction of polluting emissions and a reduction of carbon build up on spark plugs.

BRIEF DESCRIPTION OF THE DRAWINGS

For purpose of clarity, the drawings have not been drawn to scale.

FIG. 1 is a perspective view of a device for improving the fuel efficiency of an engine, in accordance with an illustrative embodiment of the invention.

FIG. 2 shows a cross sectional view of the device shown in FIG. 1, the cross section being taken along the line 2,2'.

Common elements in FIGS. 1 and 2 have the same identifying numerals.

BEST MODE FOR CARRYING OUT THE INVENTION

Referring now to the drawings in detail, the inventive fuel unit 10 comprises a magnet 12 which is located near fuel line 14. Fuel line 14 leads to the engine (not shown) of a car or truck. The magnet is oriented so that its South pole 16 is adjacent the fuel line 14 and its North pole 18 is spaced apart from the fuel line 14. The magnet 12 is embedded in the generally rectangular body 20 which is formed from a non-magnetic material such as plastic. The generally rectangular body 20 comprises an upper portion 22 and a pair of legs 24, 26 extending outward from the upper portion 22 to define a U-shaped groove 23. The magnet 12 is embedded in the upper portion 22 of the body 20. The U-shaped groove 23 is shaped so that the body 20 fits securely over the fuel line 14. The groove 23 may alternatively be V-shaped instead of U-shaped. Cut into the outer surface 30 of the body 20 is a pair of grooves 32. Each of the grooves 32 extends along the leg 24 across the upper portion 22 and along the leg 26. The grooves 32 are designed to receive the straps 34 which secure the body 20 to the fuel line 14. A diagramatically illustrated locking mechanism 36 is used to tighten the straps 34 so that the body 20 fits snugly over fuel line 14.

In the case of a gasoline automobile the fuel unit 10 is installed on the fuel line 14 as close to the carburetor as possible, making sure that the fuel unit 10 is not in contact with any part of the engine and keeping a predetermined distance, such as about 4 inches, away from the coil and distributor. The V or U-shape groove 23 in the body 20 eliminates the need to cut the fuel line to install the fuel unit. In the case of a diesel engine, the fuel unit 10 may be installed on the fuel line 14 after the injector pump and before the injectors. If there is no room at this location, or there is more than one line coming out of the injector pump, the inventive device may be installed elseware in the system such as between filters.

Although the theoretical basis by which the inventive device operates is not well understood at the present time successful results have been achieved with the inventive device.

EXAMPLES

1. A 1980 Ford with a 3.3 liter engine was tested with the inventive device in Southern California. The 1980 Ford had a base mileage rate of 18 MPG with pollution control equipment. When the magnetic fuel unit of the aforementioned patent application was installed on this car, 20 MPG was achieved with pollution equipment and 20–22 MPG was achieved without pollution equipment. When used without pollution equipment, the inventive magnetic unit resulted in 27 MPG in country driving and 24 MPG in a mixture of city and country driving.

2. A 1978 Toyota with a base gas mileage rate of 35.8 MPG for country driving was also tested. Use of the aforementioned magnetic fuel unit resulted in relatively minor fuel economy improvement in country driving, while use of the fuel unit of the present invention resulted in a gas mileage rate of 40.8 MPG in country driving. In city driving, the above-mentioned Toyota improved from 21.4 MPG to 28.9 MPG with use of the inventive fuel unit.

3. A Dodge with a 350 cu. inch engine had a base fuel economy rate of 12 MPG without emission control equipment. The magnetic-fuel unit described in the above referred to patent application improved the fuel efficiency to about 15 MPG and use of the fuel unit of the present invention improved this to 19 MPG.

The magnet 12 used in the above-mentioned tests were formed from a commercially available alloy such as Ferrinigg 7. The magnet 12 had a length of $1\frac{3}{4}$ inches, a width of $\frac{7}{8}$ inches and a thickness of $\frac{3}{8}$ inches. The body 20 in which the magnet was embedded was formed from flame retardant ABS standard plastic which is recognized as safe for automotive use. The body 20 was approximated $3\frac{1}{4}$ inches long, 1 3/16 inches wide, and 9/16 inches think near the middle. The legs 24, 26 extended outward about a quarter of an inch from the upper portion 22 of body 20.

It should be noted that in the case of diesel engines, it may be desirable to use a slightly larger magnet such as 3 inches long$\times$1 inch wide$\times 1\frac{1}{2}$ inches thick. Such a larger magnet is of course embedded in a larger generally rectangular body 20.

Finally, the above described embodiments of the invention are intended to be illustrative only. Numerous alternative embodiments may be devised by those skilled in the art without departing from the spirit and scope of the claims which follow.

What is claimed is:

1. A device positionable adjacent a fuel line of a fuel consuming apparatus for acting on fuel flowing therein for increasing the fuel efficiency of said apparatus and for reducing pollution emissions therefrom, said device comprising:

a housing comprising a body of non-magnetic material, said housing defining a longitudinally extending passage for receiving said fuel line;

means for securing said housing to said fuel line;

a magnet formed from a magnetic material magnetized with one pole on one longitudinal face thereof and the other pole on the opposite longitudinal face thereof, said magnet being embedded in said body of non-magnetic material in said housing with one of said poles adjacent and parallel to said longitudinally extending passage for positioning said one of said poles adjacent and parallel to one side of said fuel line when said device is secured thereto, there being no other magnets disposed about said fuel line between the end faces of said magnet.

2. The device according to claim 1, wherein said means for securing said housing to said fuel line comprises means for releasably securing said housing to said fuel line.

3. The device according to claim 2, wherein said releasable securing means comprises said housing having a groove in the exterior surface thereof, and a strap disposed in said groove, said strap incorporating means for releasably securing one end of the strap to the other.

4. The device according to claim 1, wherein said magnet has a length of about 1.75 inches, a width of about 0.875 inches and a thickness of about 0.375 inches.

5. The device according to claim 1, wherein said magnetic material comprises Ferrinigg 7.

6. A device positionable adjacent a fuel line of a fuel consuming apparatus for acting on fuel flowing therein for increasing the fuel efficiency of said apparatus and for reducing pollution emissions therefrom, said device comprising:

a housing comprising a body of non-magnetic material, said housing defining a longitudinally extending passage for receiving said fuel line;

means for securing said housing to said fuel line;

a magnet formed from a magnetic material magnetized with one pole on one longitudinal face thereof and the other pole on the opposite longitudinal face thereof, said magnet being embedded in said body of non-magnetic material in said housing with one of said poles adjacent and parallel to said longitudinally extending passage for positioning said one of said poles adjacent and parallel to one side of said fuel line when said device is secured thereto, there being no other magnets disposed about said fuel line between the end faces of said magnet, said magnet being embedded in said body of non-magnetic material with no part of said magnet exposed to or in contact with said fuel line when said housing is secured thereto.

* * * * *